US005950733A

United States Patent [19]

Patel

[11] Patent Number: 5,950,733

[45] **Date of Patent: *Sep. 14, 1999**

[54] FORMATION ISOLATION VALVE

[75] Inventor: Dinesh R. Patel, Sugar Land, Tex.

[73] Assignee: Schlumberger Technology Corporation, Sugar Land, Tex.

[ * ] Notice: This patent is subject to a terminal disclaimer.

[21] Appl. No.: 09/108,674

[22] Filed: Jul. 1, 1998

Related U.S. Application Data

[63] Continuation of application No. 08/646,673, May 10, 1996, Pat. No. 5,810,087.

[51] Int. Cl.[6] ..... E21B 43/12

[52] U.S. Cl. ..... 166/373; 166/323; 166/332.4

[58] Field of Search ..... 166/373, 332.3, 166/332.5, 334.2, 334.3, 334.4, 320, 321

[56] References Cited

U.S. PATENT DOCUMENTS 5,337,827 8/1994 Hromas et al. ..... 166/321
5,518,073 5/1996 Manke et al. ..... 166/321
5,664,629 9/1997 Maitland ..... 166/321
5,810,087 9/1998 Patel ..... 166/373

*Primary Examiner*—William Neuder
*Attorney, Agent, or Firm*—Gordon Waggett; John Ryberg

[57] ABSTRACT

A formation isolation valve (FIV) method and apparatus is disclosed for building a tool string of any desired length prior to lowering that tool string downhole for the purpose of performing wellbore operations during a single trip into the wellbore. The formation isolation valve apparatus includes a valve, such as a ball valve, initially disposed in an open position and adapted to be changed from the open position to a closed position when a shifting tool is run through the center of the valve; and a hydraulic section including a rupture disc assembly and a pair of chambers separated by an oil metering orifice which is responsive to the previous closure of the valve by the run of the shifting tool through the center of the valve and is further responsive to the further running of the shifting tool through the center of the hydraulic section for changing the valve back from the closed position to the open position thereby reopening the valve when a predetermined internal tubing pressure inside the FIV exceeds a predetermined threshold pressure value rating of the rupture disc assembly.

17 Claims, 5 Drawing Sheets

FIG. 5a
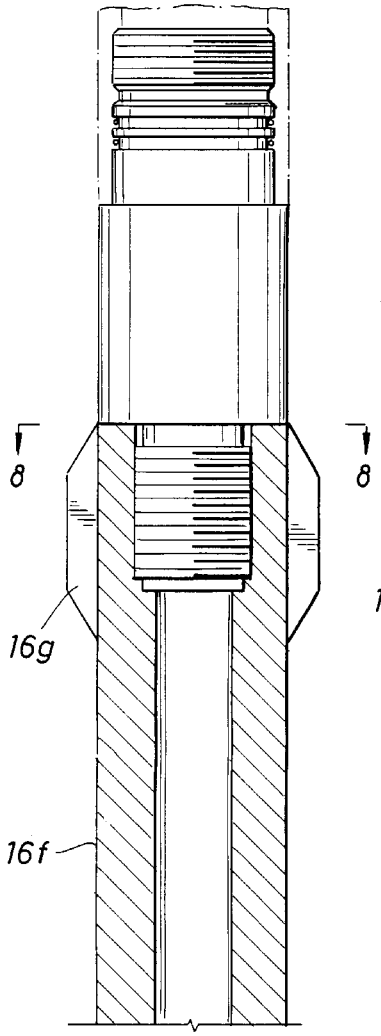
FIG. 5b
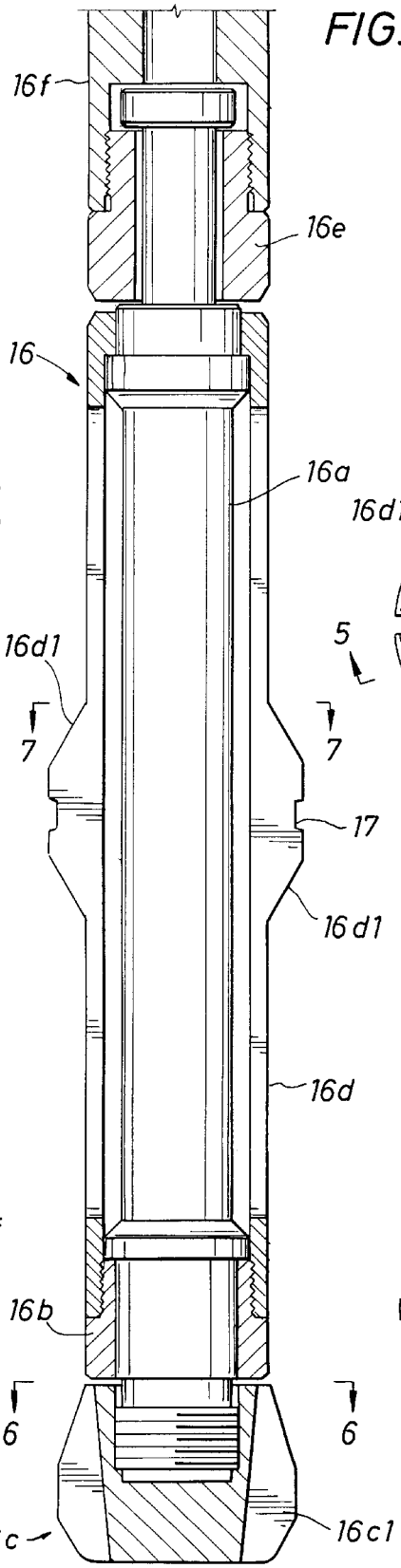
| |
|---|
| FIG. 5a |
| FIG. 5b |
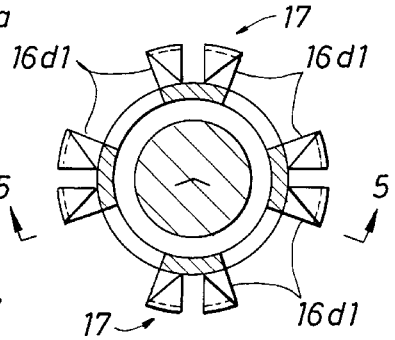
FIG. 7
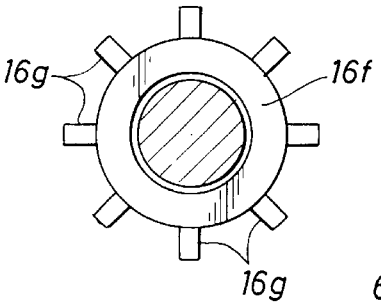
FIG. 8
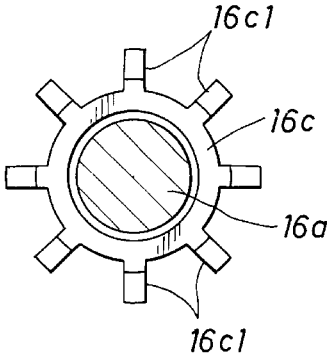
FIG. 6

| |
|---|
| FIG. 9a |
| FIG. 9b |
| FIG. 9c |
| FIG. 9d |

FORMATION ISOLATION VALVE

CROSS-REFERENCE TO RELATED APPLICATION

This is a continuation of U.S. patent application Ser. No. 08/646,673, filed May 10, 1996, now U.S. Pat. No. 5,810,087.

BACKGROUND OF THE INVENTION

The subject matter of the present invention relates to a method and apparatus for isolating a first section of a wellbore from a second section of the wellbore which is disposed below the first section and adjacent a formation penetrated by the wellbore in order that a wellbore tool string of any desired length may be made up in the first section prior to opening a ball valve, and lowering the tool string downhole into the second section of the wellbore for performing one or more wellbore operations downhole in the second section.

When performing wellbore operations downhole, it is necessary to first make up a tool string at the surface of the wellbore prior to lowering that tool string downhole for performing the wellbore operations. In the past, the length of the tool string was limited and a longer tool string length was often desired. Therefore, when the tool string performed the wellbore operations downhole, that tool string was raised uphole and another, second tool string was made up at the surface of the wellbore. The second tool string was lowered downhole for performing additional wellbore operations. However, it is time consuming and expensive to continually make up additional tool strings at the wellbore surface, following the performance of the initial wellbore operation by the first tool string, and sequentially lower those additional tool strings downhole for performing additional wellbore operations. It would be desirable to make up one tool string having the desired length at the wellbore surface and to lower that desired tool string downhole for performing a wellbore operation during one trip into the wellbore. For example, when the tool strings include perforating guns, in the past, it was necessary to implement the following perforating procedure when perforating long length intervals of a wellbore: perforate the long length interval during multiple trips into the wellbore by making up, at the wellbore surface, a first perforating gun having a limited first length, lowering the first perforating gun downhole, perforating a formation penetrated by the wellbore, raising the first perforating gun uphole (or dropping that perforating gun to the bottom of the wellbore), making up a second perforating gun having another second limited length at the wellbore surface, lowering the second perforating gun downhole, perforating another section of the formation, raising the second perforating gun uphole (or dropping it to a bottom of the wellbore), etc. The above referenced perforating procedure is time consuming and costly.

As a result, it became necessary to design a method and apparatus for creating a tool string, of any desired length, uphole at the surface of the wellbore, so that the tool string may be lowered downhole and wellbore operations performed downhole during only one trip into the wellbore. U.S. Pat. 5,509,481 to Huber et al discussed one method for perforating long length intervals of a formation during a single run into the wellbore. The Huber apparatus disclosed an automatic release apparatus which would disconnect one part of a long gun string from a second part of the gun string just before the perforating guns of that gun string would detonate.

Another prior pending application also discloses a method and apparatus for making up, at the wellbore surface, a tool string of any desired length prior to lowering that tool string downhole for performing a wellbore operation in the wellbore during one trip into the wellbore. In a prior pending application entitled "Completions Insertion and Retrieval Under Pressure (CIRP) Apparatus including the Snaplock Connector", filed on Apr. 25, 1996, corresponding to attorney docket number 22.1183, and corresponding to a prior filed provisional application Ser. No. 60/010,500 filed Jan. 24, 1996 (hereinafter, the "CIRP application"), a tool string of any desired length is built uphole prior to lowering that tool string downhole by first holding a first tool, having a first and a second section of a snaplock connector connected thereto, in a deployment BOP or snaplock operator while suspending a second tool, also having a third section of the snaplock connector connected thereto, by wireline in a lubricator. The second tool is lowered down through the lubricator and through a master valve by operating a winch until the third section of the snaplock connector on the second tool connects to the second section of the snaplock connector on the first tool thereby forming a first tool string having a length which corresponds to the first tool and the second tool. The hold by the deployment BOP is released from the first tool, the first tool string is lowered, and the deployment BOP grips the second tool. The second tool also includes another first, second, and third section of a snaplock connector connected to its opposite side, the third section (called a deployment stinger) being connected to the wireline. The deployment stinger is raised uphole by operating the winch, and it is replaced by a third tool, such as a firing head, which also includes a third section of a snaplock connector. The third tool suspends by the wireline in the lubricator and it is lowered downhole and attached to the second tool being held by the deployment BOP. The hold by the deployment BOP on the second tool is released, and a resultant tool string of the desired length, consisting of the first tool, the second tool, and the third tool, is lowered downhole for the purpose of performing wellbore operations downhole during one trip into the wellbore.

However, another alternate apparatus, and corresponding method, is needed for isolating the formation downhole by means of closing a valve so that wellhead pressure can be bled off for building a long tool string uphole of any desired length and lowering that tool string downhole without a need for snubbing under wellhead pressure for the purpose of performing wellbore operations downhole during a single trip into the wellbore.

SUMMARY OF THE INVENTION

Accordingly, it is a primary object of the present invention to provide another alternate method and apparatus for building a tool string uphole of any desired length prior to lowering that tool string downhole for the purpose of performing wellbore operations downhole during a single trip into the wellbore.

It is a further object of the present invention to provide another alternate method and apparatus for building a tool string uphole of any desired length prior to lowering that tool string downhole for the purpose of performing wellbore operations downhole during a single trip into the wellbore, the alterate apparatus including a valve, such as a ball valve, initially disposed in an open position adapted to be changed from the open position to a closed position when a shifting tool is run through the center of the valve; and a hydraulic section including a rupture disc assembly and a pair of chambers separated by an oil metering orifice, responsive to the closure of the valve by the shifting tool, and further responsive to the further running of the shifting tool through the center of the hydraulic section for changing the valve back from the closed position to the open position thereby reopening the valve in response to a predetermined internal tubing pressure that is greater than a predetermined threshold pressure value.

In accordance with these and other objects of the present invention, the formation isolation valve of the present invention can be used for building a tool string uphole of any desired length for the purpose of performing wellbore operations downhole during one trip into the wellbore. The formation isolation valve having a full bore includes a valve, such as a ball valve, assumed to be initially disposed in the open condition and a hydraulic section. A shifting tool, run at the end of the perforating guns, is pulled out through the full bore of the valve of the formation isolation valve after the guns are fired and the well is perforated. An outer periphery of the shifting tool hooks onto the end of a collet finger that is connected to the valve. As the shifting tool comes up through the full bore of the valve, the periphery of the shifting tool forces the end of the collet finger to move in a direction which effectively closes the valve. After the valve is closed, a pressure existing in the area above the valve can now be bled off. When the pressure in the area above the valve is bled off, the tool string (perforating gun and shifting tool) can be retrieved to the surface with the well shut-in downhole and with wellhead pressure bled off. When the shifting tool is retrieved to the surface, the shifting tool continues its run up through the center of the formation isolation valve, and, as a result, the outer periphery of the shifting tool hooks onto the end of another collet finger of an isolation latch assembly thereby pulling a first port into alignment with another, second entry port. At this point, before operating the hydraulics section, the shifting tool can be re-run down through the formation isolation valve thereby re-opening the valve and it can be re-run up through the formation isolation valve thereby re-closing the valve. Since the hydraulics section has not yet been operated, the rupture discs of the hydraulics section have not yet been ruptured. Whenever the shifting tool is run down through the formation isolation valve, the valve opens and whenever the shifting tool is pulled out of the formation isolation valve, the valve is re-closed. Now, when another tool string of any desired length (e.g., a tool string which is longer in length than the length of a wellhead lubricator) is disposed inside the area above the valve, it is now necessary to lower that tool string downhole for the purpose of performing wellbore operations. At this point, it is necessary to reopen the valve so that the tool string can be lowered downhole for performing the wellbore operations. In order to reopen the valve, since the rupture discs of the hydraulics section have not yet been ruptured, it is necessary to initiate the operation of the hydraulics section and rupture the rupture discs. The hydraulics section can be used only once; therefore, it should not be operated until the tool string of any desired length must be lowered downhole. Recall that, when the shifting tool continued its run up through the center of the formation isolation valve, the outer periphery of the shifting tool hooked onto the end of another collet finger of an isolation latch assembly thereby pulling a first port into alignment with another, second entry port. In order for the shifting tool to initiate the operation of the hydraulics section, since the two ports have fallen into alignment with one another, an internal tubing pressure enters the ports and that pressure is exerted against a rupture disc. When the internal tubing pressure is greater than or equal to a predetermined threshold pressure value associated with that rupture disc, the rupture disc will rupture. When the rupture disc ruptures, a piston begins to move downwardly in response to the internal tubing pressure thereby forcing an oil in a first oil chamber to move through an oil metering orifice to a second chamber. When all of the oil meters through the orifice to the second chamber, the piston bottoms out. When the piston bottoms out, the valve has been reopened. When the valve is reopened, the tool string of any desired length, which is disposed inside the area above the valve, can now move through the valve to an area below the valve in the wellbore for performing the wellbore operations in the area below the valve. The wellbore operations are performed during a single trip into the wellbore. In addition, when the piston bottoms out, the piston cannot be moved upwardly because the pressure existing on the top side of the piston is greater than the pressure existing on the bottom side of the piston. As a result, in order to allow the piston to be moved upwardly when it bottoms out, a second rupture disc, located on a side opposite the first rupture disc, will rupture.

When the second rupture disc ruptures, the pressure existing on the bottom side of the piston becomes equal to the pressure existing on the top side of the piston. When the two pressures existing on the top side and the bottom side of the piston are equal, the piston can now be moved upwardly for reclosing the valve.

To be more specific, the formation isolation valve (FIV) of the present invention consists of a ball valve, upper and lower ball valve supports, a ball valve seal, a ball valve operator, and a spring. The ball valve is rotated to the closed position by moving the ball operator down. The ball valve operator is connected to a latch assembly. The latch assembly consists of two sets of collets, an upper collet for closing the ball valve when in the engaged position and a lower collet for opening the ball valve when in the engaged position. Each collet consists of multiple fingers which move radially inwardly when passed through a small inner diameter and then return back to its natural free position when in open space. A certain force is required to move the collet from the unlatched to the latched position. A hydraulic section consists of an upper and a lower oil chamber which are interconnected together by an oil metering orifice. The orifice provides a time delay. A first pressure isolation device (first rupture disc) is fitted in a power piston for the purpose of connecting pressures in both oil chambers at the end of the operator mandrel downstroke. A pressure transfer section consists of a housing, rupture disc, and an isolation latch assembly, similar to the latch mandrel assembly. The rupture prevents the tubing pressure from acting on the power piston until the rupture disc is ruptured. The isolation latch assembly prevents the tubing pressure from acting on the rupture disc until the isolation latch assembly is shifted up and the pressure port is exposed to tubing pressure. The purpose of the isolation latch assembly is to protect the rupture disc from premature rupturing due to high pressure spikes generated during firing of the perforating guns. A shifting tool consists of a mandrel and a collet. The collet of the shifting tool consists of multiple fingers which move radially inwardly when passed through a restriction and then move back to its natural position when removed from the restriction. Two types of collets are used: a collet with ledges on both sides of a groove for opening and closing the ball valve, and a collet with a ledge only on the top side for opening the ball valve. The shifting tool is decoupled from the gun string, and is free to move and rotate. The purpose of decoupling is to minimize the wear on the collet fingers. An upper centralizer is fixed to the gun string and it takes wear due to the weight of the horizontal gun and tubing string. The load does not transfer to the shifting tool collet fingers.

The functional operation of the formation isolation valve of the present invention is briefly summarized as follows. The formation isolation valve (FIV) is run into the wellbore in an open position. A perforating gun is run through the full bore of the FIV and the wellbore is perforated. When the perforating gun is fired, the inner diameter of the FIV is filled with wellbore fluid. After firing the perforating gun, the tubing is snubbed out under wellhead pressure and the perforating gun is raised uphole until the collet on the shifting tool connected to the perforating gun latches onto the upper collet fingers of the latch assembly. An upward 2000 pound pull is applied in order to disengage the fingers of the lower collet. As a result, the latch assembly and the ball valve operator move up thereby closing the ball valve. The shifting tool is disengaged from the upper collet fingers when the fingers move radially outward and into the groove in the latch housing inner diameter. Then, the tubing pressure is bled off and the ball valve seal is pressure tested with shut in pressure from below (500 psi higher than tubing pressure in this case). It can also be pressure tested from above since the ball valve holds pressure from both directions. During the time when the guns and the shifting tool are pulled out, the shifting tool collet will engage with the isolation latch assembly and move it upwardly thereby uncovering the pressure port. The first rupture disc is now exposed to the tubing pressure. The tubing and guns are retrieved to the surface with the tubing pressure bled off. At some time later, in order to reopen the ball valve and flow the well, the tubing pressure is increased to rupture the first rupture disc. When the first rupture disc is ruptured, the operator mandrel starts to move down with time delay. Oil starts to meter from the oil chamber to the atmospheric chamber through the oil metering orifice. After five minutes of time delay, the time delay device is disabled (oil no longer meters slowly through the oil metering orifice) and the operator mandrel moves down at a rapid rate. This five minutes of time delay is enough time to bleed off the tubing pressure to prevent formation damage when the ball valve opens. At the end of the time delayed stroke, the operator mandrel engages with the latch assembly and the ball operator and pushes it down. The ball valve is now open and the latch assembly is locked in place. At the end of the stroke, the power piston bottoms out on the oil housing which creates a differential pressure across the second rupture disc (atmospheric pressure on the oil chamber side and tubing pressure on the other side), and this differential pressure ruptures the second rupture disc. This disables the function of the piston mandrel (same pressure on both sides of the piston mandrel). A further application of a high pull will push the collet fingers on the shifting tool radially inwardly thereby disengaging the shifting tool from the latch assembly in the event the shifting tool cannot be unlatched from the latch assembly with the application of a normal pull. This feature allows the shifting tool to be removed in the event of a downhole tool malfunction.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein:

FIGS. 5*a* and 5*b* illustrate the shifting tool used in conjunction with the FIV of FIGS. 1–4;

FIG. 6 illustrates a cross section of the shifting tool of FIG. 5*a* taken along section lines 6—6 of FIG. 5*a;*

FIG. 7 illustrates a cross section of the shifting tool of FIG. 5*a* taken along section lines 7—7 of FIG. 5*a;*

FIG. 8 illustrates a cross section of the shifting tool of FIG. 5*b* taken along section lines 8—8 of FIG. 5*b;*

DETAILED DESCRIPTION OF THE PREFERRED EMBODIMENT

Figures 1, 10A, 10B:
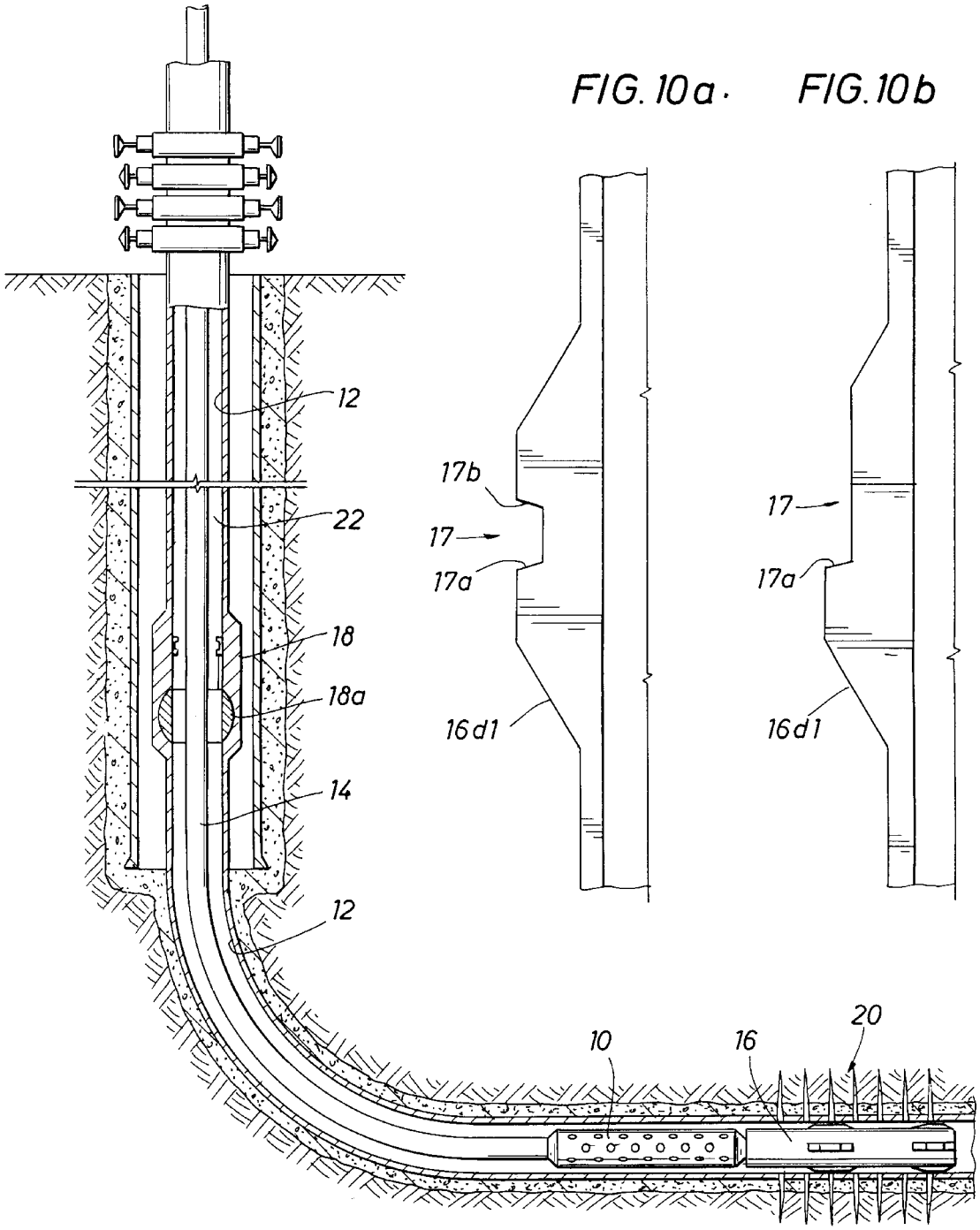
FIG. 1 illustrates a wellbore including a shifting tool and a formation isolation valve (FIV) of the present invention.
FIGS. 10*a* and 10*b* illustrate the groove 17 of the collet 16*d*1 shown in FIG. 5*a* of the drawings.

Referring to FIG. 1, a wellbore is illustrated in which the formation isolation valve (FIV) and the shifting tool of the present invention is illustrated.

In FIG. 1, a perforating gun 10 connected to the end of a tubing string 14, or to the end of a coiled tubing 14, is disposed in a horizontal or deviated wellbore 12. A shifting tool 16, part of the present invention, is connected to a bottom part of the perforating gun 10. In addition, a formation isolation valve (FIV) 18 surrounds the tubing string or coiled tubing 14 in FIG. 1. The FIV 18 includes a valve 18*a*. When the perforating gun 10 is raised uphole, the FIV 18 surrounds the shifting tool 16 in FIG. 1 (that is, when the perforating gun 10 is raised uphole, the shifting tool 16 is enclosed by the FIV). The FIV 18 is part of the formation or casing when the perforating gun 10 suspends from a tubing string, the FIV 18 being part of the tubing string when the perforating gun 10 suspends from a coiled tubing.

In operation, referring to FIG. 1, the perforating gun 10 perforates the formation 20 penetrated by the wellbore 12. Then, the perforating gun 10 is raised uphole following the perforating operation. The perforating gun 10 eventually passes through the FIV 18 in FIG. 1, and then the shifting tool 16 passes through and is enclosed by the FIV 18 in FIG. 1. Assuming that the valve 18*a* is initially disposed in the open position, when the shifting tool 16 passes through the FIV 18, the shifting tool 16 closes the valve 18*a* of the FIV 18 thereby changing the valve 18*a* from the open position to the closed position. The shifting tool 16 in the FIV 18 remains stationary. Now that the valve 18*a* is closed, the area 22 above the closed valve 18*a* in the wellbore 12 can be used to build a tool string of any desired length. Assuming that a new tool string is built in the area 22 with the valve 18*a* closed, it is time to lower that new tool string downhole for performing a new wellbore operation. Before the new tool string can be lowered downhole, the valve 18*a* must be reopened. Recalling that the shifting tool 16 remained stationary in the FIV 18, in order to reopen the valve 18*a,* the shifting tool 16 is raised uphole once again. When the shifting tool 16 is raised uphole, an internal tubing pressure, inside the coiled tubing or tubing string 14, is increased. When the internal tubing pressure is increased beyond a predetermined threshold pressure value, and after a period of time elapses following the increase of the internal tubing pressure beyond the threshold pressure value, the valve 18*a* will reopen. Now, the new tool string may be lowered downhole for performing the new wellbore operation. Alternatively, the FIV 18 and associated shifting tool 16 may be used to simply open and close the valve 18*a* for purposes of conducting a simple drill stem test.

Figure 2:
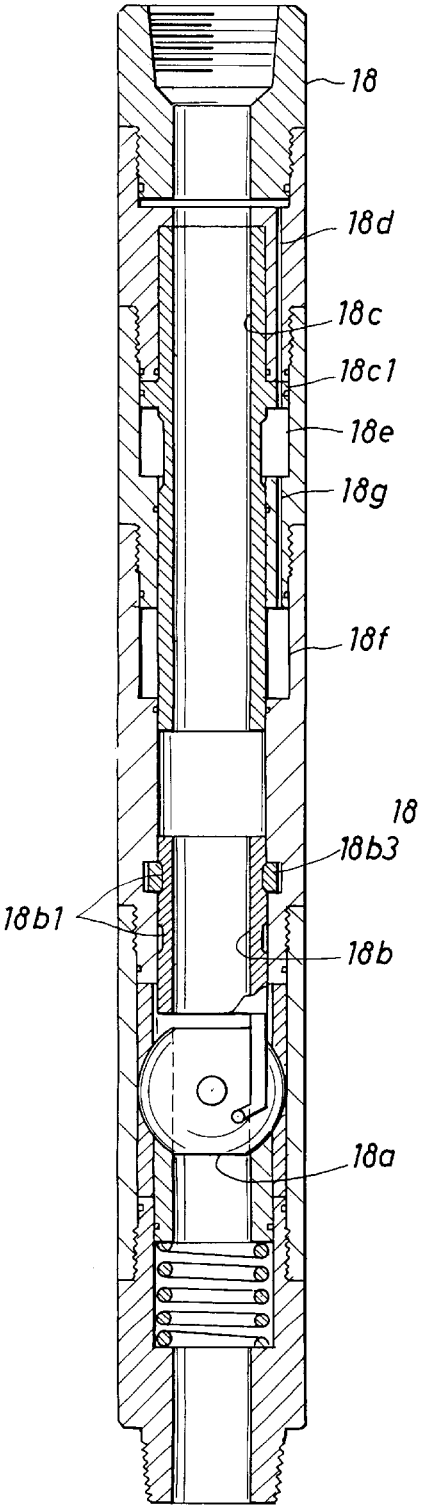
FIGS. 2–4 illustrate the FIV in a run-in open position, a closed position, and an open (i.e., re-opened) position.
Figure 3:
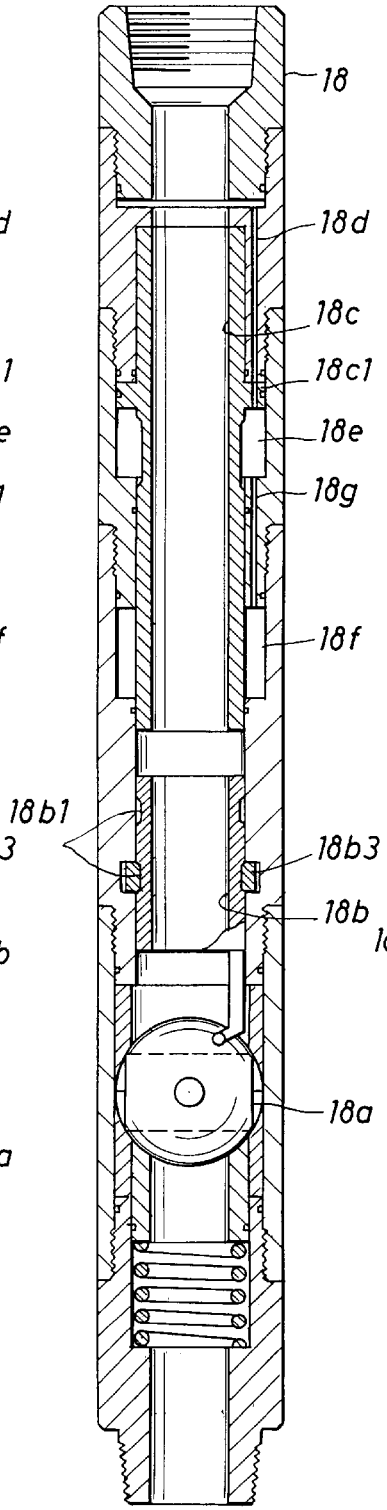
Figure 4:
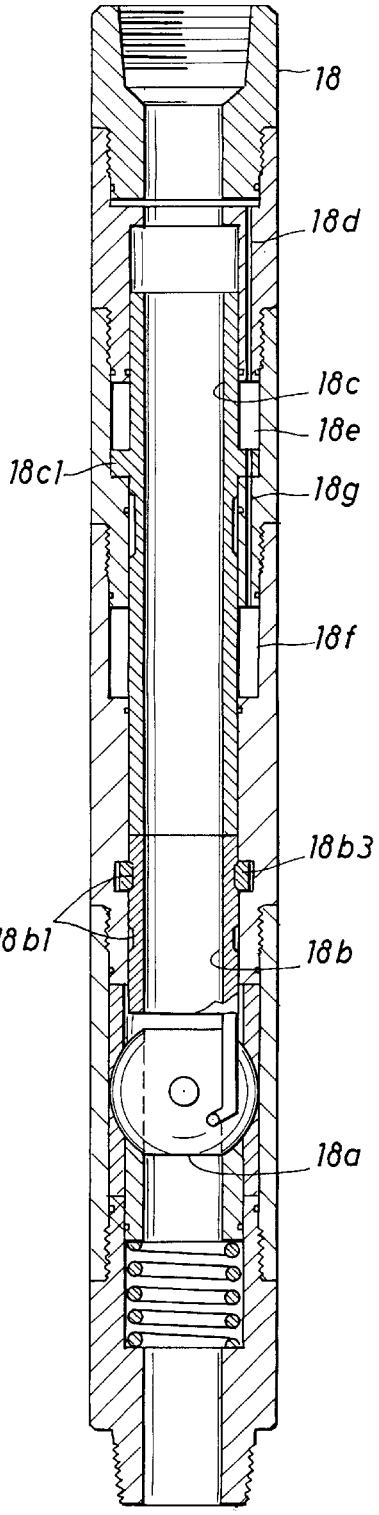

Referring to FIGS. 2–4, a simplified construction of the formation isolation valve (FIV) 18 of the present invention is illustrated. FIG. 2 illustrates the FIV 18 in its initial run-in position, FIG. 3 illustrating the FIV 18 in its closed position, and FIG. 4 illustrating the FIV 18 in its reopened position.

In FIG. 2, the valve 18*a* of the FIV 18 of the present invention is actually a ball valve 18*a* that is connected to a ball operator 18*b*. The ball operator 18*b* includes a pair of grooves 18*b*1 in which a detent 18*b*3 is disposed. An upward longitudinal movement of the ball operator 18*b* will cause the detent 18*b*3 to move out of one groove and fall into the other groove of the pair of grooves 18*b*1 and then the ball operator 18*b* will rotate the ball valve 18*a* from the run-in open position shown in FIG. 2 to the closed position shown in FIG. 3. In addition, an operator mandrel 18*c* includes a piston 18*c*1, and the piston 18*c*1 includes a second rupture disc. A fluid communication channel 18*d* is interconnected between a first rupture disc, which is responsive to a fluid pressure inside the internal full bore of the FIV, and the piston 18*c*1. The fluid pressure inside the internal full bore of the formation isolation valve exerts itself against the first rupture disc. When the fluid pressure inside the full bore of the FIV 18 is greater than or equal to a predetermined threshold pressure value established by the first rupture disc, the first rupture disc ruptures and the fluid pressure inside the internal full bore of the FIV will travel through channel 18*d* and will be exerted against the piston 18*c*1. Below the piston 18*c*1, an oil chamber 18*e* fluidly communicates with an atmospheric chamber 18*f* via an oil metering orifice 18*g*. When the fluid pressure inside the full bore of the FIV 18 is exerted against the piston 18*c*1, the piston 18*c*1 and the operator mandrel 18*c* will move, and, in response to movement of the piston 18*c*1, the oil in the oil chamber 18*e* will start to meter slowly through the oil metering orifice 18*g* and into the atmospheric chamber 18*f*, this metering of the oil through the orifice 18*g* establishing a five minute time delay period (that is, it takes 5 minutes for the oil in the oil chamber 18*e* to meter through the orifice 18*g* and into the atmospheric chamber 18*f*). When this five minute period has elapsed, the operator mandrel 18*c* will have moved longitudinally from its uppermost position shown in FIG. 3 to its lowermost position shown in FIG. 4. The downward movement of the operator mandrel 18*c* will also cause the ball operator 18*b* to move downwardly from its position shown in FIG. 3 to its position shown in FIG. 4. When the ball operator 18*b* moves to its position shown in FIG. 4, the ball valve 18*a* will have rotated thereby changing from the closed position shown in FIG. 3 to the open position shown in FIG. 4.

A more detailed construction of the formation isolation valve 18 and the shifting tool 16 of the present invention will be set forth in the following paragraphs with reference to FIGS. 5*a* through 9*d* of the drawings.

Referring to figures 5*a*, 5*b*, 6, 7, and 8 of the drawings, the shifting tool 16, which comprises a part of the present invention, is illustrated.

In FIG. 5*b*, the shifting tool 16 includes a collet mandrel 16*a*, a locking nut 16*b* secured to the collet mandrel 16*a*, an end cap 16*c*, which functions as a centralizer, also secured to the collet mandrel 16*a*, a collet member 16*d* threadedly secured to the locking nut 16*b*, and an opening/closing collet 16*d*1 integrally connected to the collet member 16*d*, the opening/closing collet 16*d*1 including a groove 17 disposed circumferentially around the outer periphery of the collet 16*d*1. In FIG. 5*b*, a split nut 16*e*, which functions as a decoupler, is secured to the collet mandrel 16*a*, and a top sub 16*f* is secured to the split nut 16*e*. In FIG. 5*a*, the end of the top sub 16*f* also includes a centralizer 16*g*. Therefore, the end cap 16*c* of FIG. 5*b* includes a centralizer 16*c*1, and the top sub 16*f* of FIG. 5*a* also includes a centralizer 16*g*. In FIG. 6, a cross sectional view of the end cap 16*c* is shown. In FIG. 7, a cross sectional view of the collet 16*d*1 including the groove 17 is illustrated. In FIG. 8, a cross sectional view of the centralizers 16*g* of the top sub 16*f* is illustrated. Note that, in the following description, the groove 17 disposed around the outer periphery of the collet 16*d*1 in FIG. 5*b* will be used to open and close the ball valve 18*a*.

Referring to FIGS. 9*a*–9*d*, a detailed construction of the formation isolation valve (FIV) 18 of the present invention, which utilizes the shifting tool 16 of FIGS. 5*a*–5*b*, is illustrated.

Figure 9A:
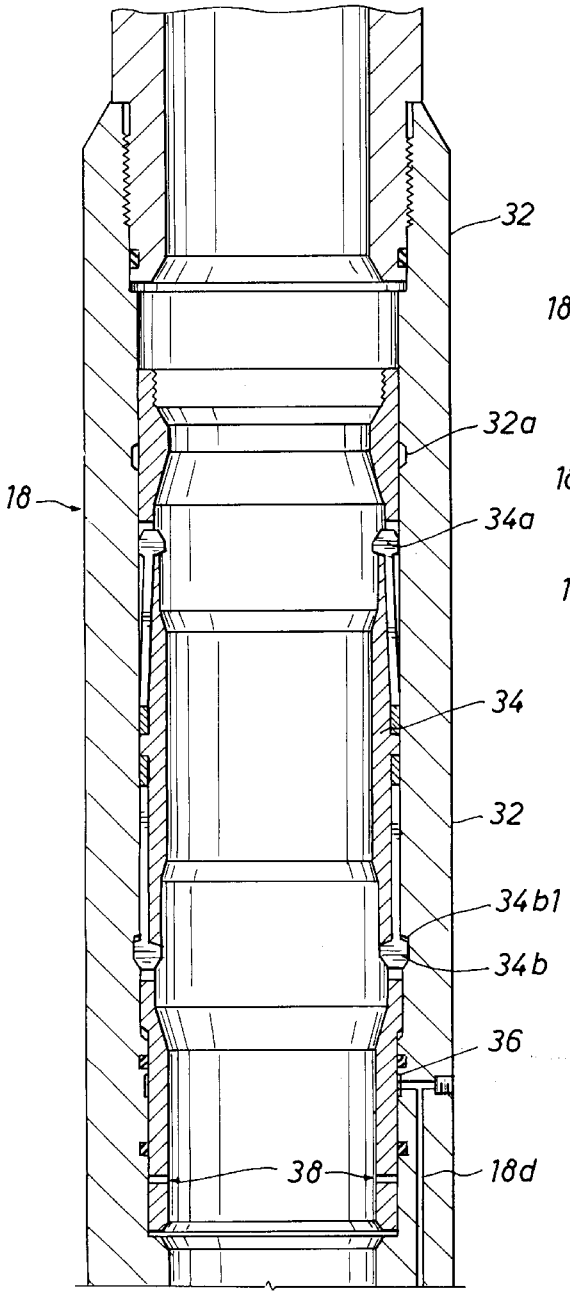
FIGS. 9*a*–9*d* illustrate a more detailed construction of the FIV of FIGS. 1 and 2–4.
Figure 9B:
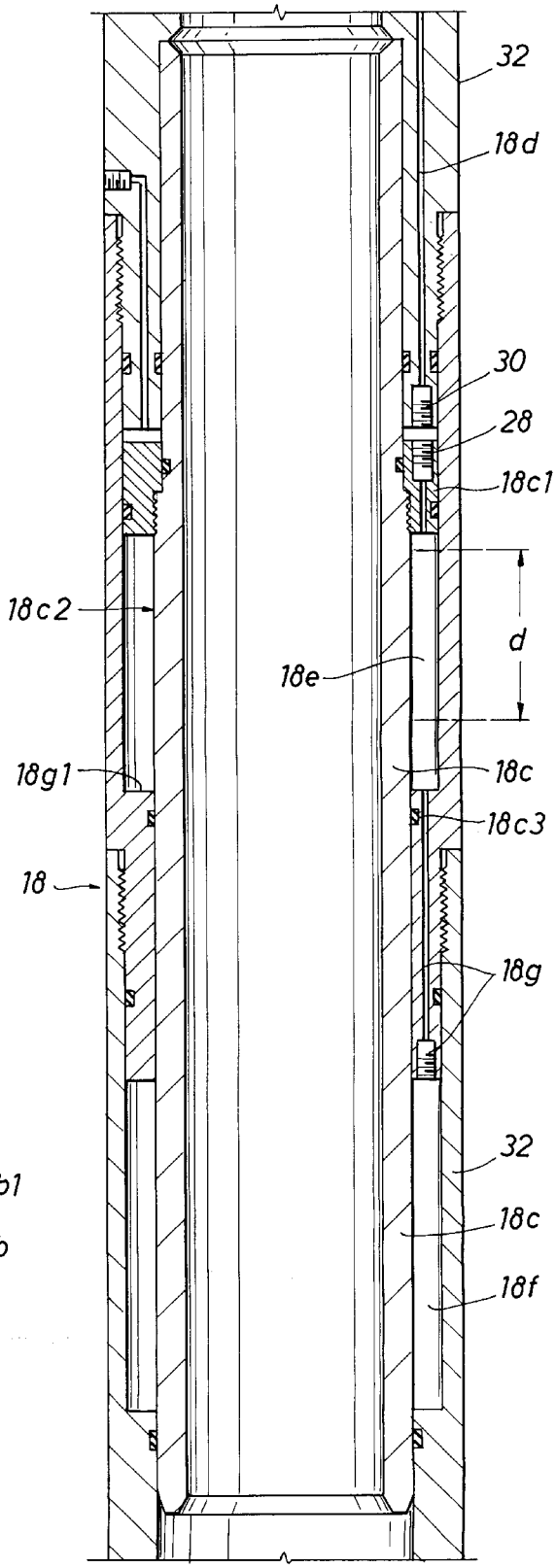
Figure 9C:
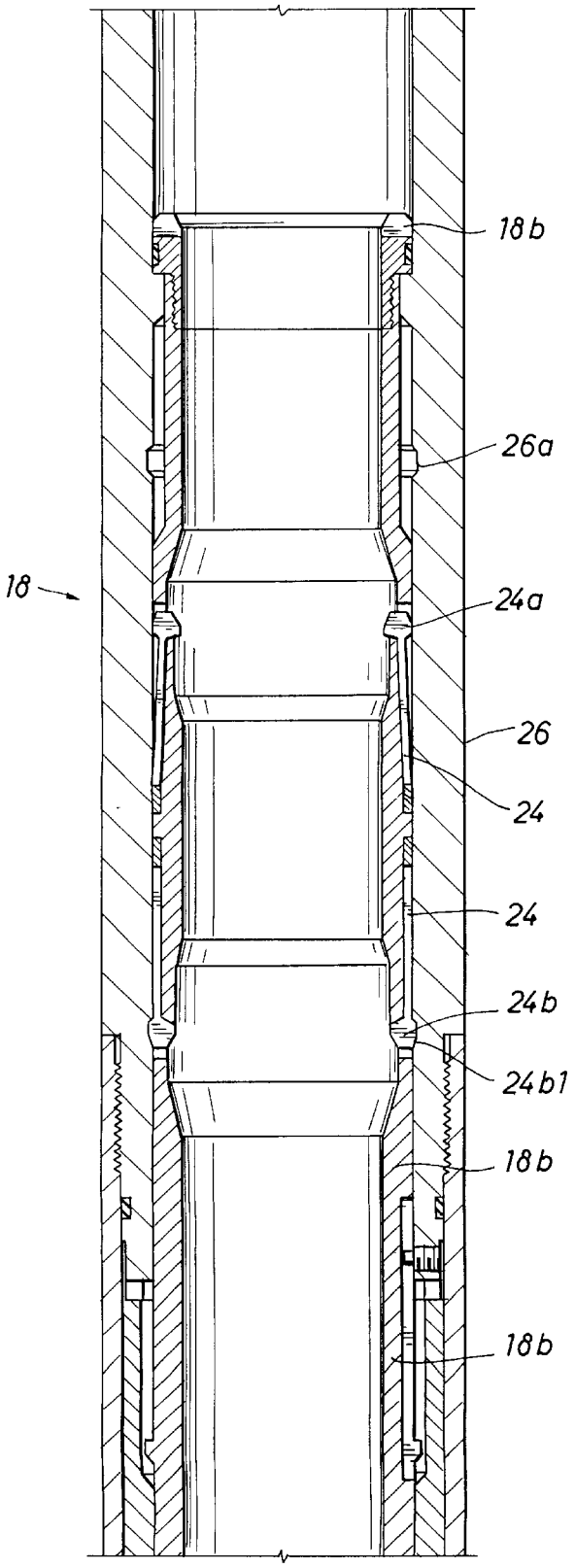
Figure 9D:
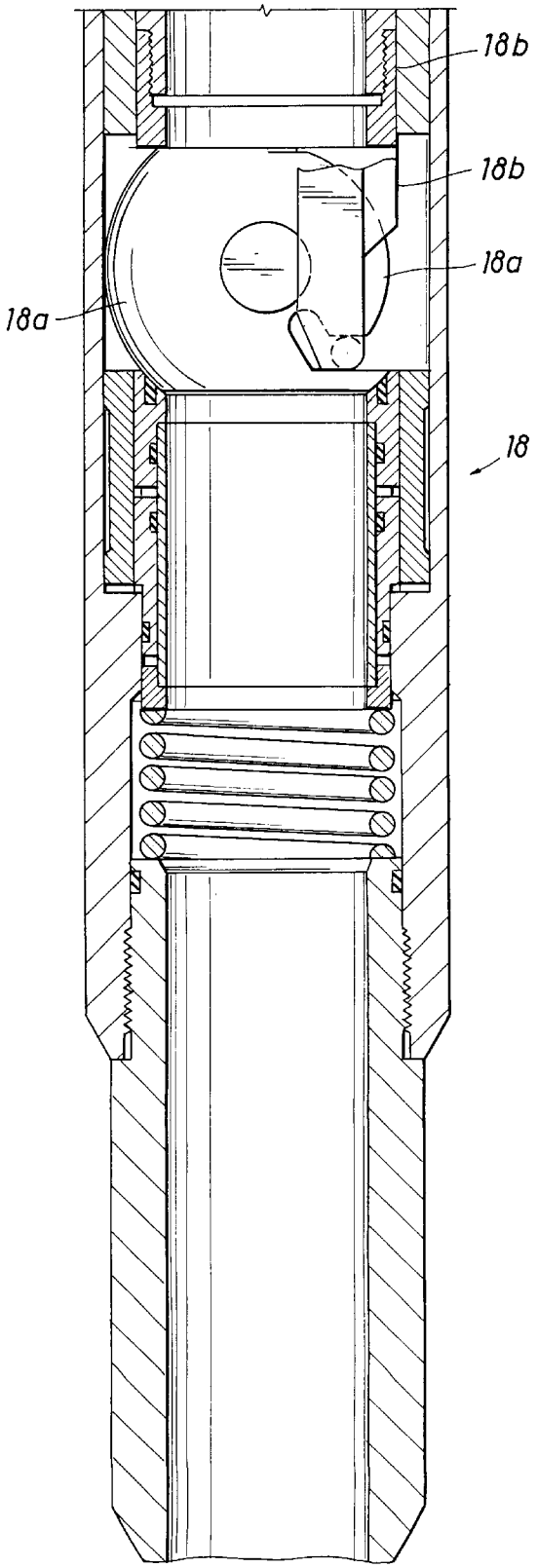

In FIG. 9*d*, the FIV 18 includes a ball valve 18*a* and a ball operator 18*b* connected to the ball valve 18*a*. Movement of the ball operator 18*b* will rotate the ball valve 18*a* thereby opening and closing the ball valve 18*a*. The ball operator 18*b* is also shown in FIG. 9*c*. In addition, in FIG. 9*c*, a pair of collet fingers 24 are connected to the ball operator 18*b* and include a first collet finger and a second collet finger, the first collet finger having a first end 24*a*, the second collet finger having a second end 24*b*, the second end 24*b* being adapted to be disposed in its own detent 24*b*1 which is shown in FIG. 9*c*. The pair of collet fingers 24 will move longitudinally when the shifting tool 16 is run through the center of the FIV 18. When the collet fingers 24 move longitudinally in FIG. 9*c* through the FIV 18, the ball operator 18*b* is also moved longitudinally in the same direction. Furthermore, in FIG. 9*c*, an outer housing 26 includes an interior groove 26*a* which is adapted to receive the first end 24*a* of the collet finger 24 when the collet finger 24 and the ball operator 18*b* are moved longitudinally within the FIV 18 (recall the ball valve 18*a* rotates to either the closed or open position when the ball operator 18*b* moves longitudinally within the FIV 18).

In FIGS. 9*a* and 9*b*, starting with FIG. 9*a*, an operator mandrel 18*c* includes a piston 18*c*1 which moves longitudinally when the operator mandrel 18*c* moves longitudinally within the FIV 18. The piston 18*c*1 further includes a second rupture disc 28 disposed longitudinally through the piston 18*c*1. On the other hand, a rupture disc sub 32 in FIG. 9*b* includes a fluid communication channel 18*d* disposed longitudinally through the sub 32, the channel 18*d* being fluidly interconnected between an entry port 36, in FIG. 9*a*, which is disposed adjacent the internal full bore of the FIV 18 and a first rupture disc 30 in FIG. 9*b*. Furthermore, in FIG. 9*b*, the rupture disc sub 32 and the operator mandrel 18*c* define a fluid chamber 18*e* filled with a fluid, such as oil. That side of the operator mandrel 18*c* which is disposed inside the fluid chamber 18*e* includes a cut 18*c*2 which has a length "d", as shown in FIG. 9*b*. In addition, a seal or o-ring 18*c*3 in FIG. 9*b* is disposed firmly in contact with said side of the operator mandrel 18*c* which is disposed inside the oil chamber 18*e*. When the cut 18*c*2 is disposed adjacent the o-ring 18*c*3 in FIG. 9*b*, the cut 18*c*2 will allow oil in the oil chamber 18*e* to quickly flow from the oil chamber 18*e* to the atmospheric chamber 18*f* at a more rapid rate. In addition the rupture disc sub 32 and the operator mandrel 18*c* further define an atmospheric chamber 18*f* and a fluid metering orifice 18*g* which is disposed between the fluid chamber 18*e* and the atmospheric chamber 18*f*. The fluid metering orifice 18*g* is designed to meter any fluid from the fluid chamber 18*e* slowly through the fluid metering orifice 18*g* to the atmospheric chamber 18*f* in response to movement of the piston 18*c*1. Functionally, when the operator mandrel 18*c* moves, the piston 18*c*1 also slowly moves. As the piston 18*c*1 moves, the fluid in the fluid chamber 18*e* will meter slowly through the fluid metering orifice 18*g* to the atmospheric chamber 18*f*. However, when the cut 18*c*2 in the operator mandrel 18*c* is disposed adjacent the o-ring 18*c*3, the operator mandrel 18*c* and the piston 18*c*1 will move very rapidly. As a result, when the cut 18*c*2 is disposed adjacent the o-ring 18*c*3, the piston 18*c*1 will very quickly bottom out against one end 18*g* of the fluid metering orifice 18*g*.

In FIG. 9*a*, a longitudinally movable isolation latch assembly 34 initially blocks the entry port 36. The isolation latch assembly 34 includes a port 38 which is adapted to move into alignment with the entry port 36 in the rupture disc sub 32 when the isolation latch assembly 34 moves longitudinally within the FIV 18. The isolation latch assembly 34 includes a pair of collet fingers, the first collet finger of the isolation latch assembly 34 having a first end 34*a*, the second collet finger of the isolation latch assembly having a second end 34*b*, the second end 34*b* being adapted to be disposed in its own detent 34*b*1 which is shown in FIG. 9*a*. The isolation latch assembly 34 will move longitudinally when the shifting tool 16 of FIGS. 5*a*–5*b* is run through the center of the FIV 18 and catches the first or second end 34*a* or 34*b* of the collet fingers of the isolation latch assembly 34, as discussed below.

Referring to figures 10*a* and 10*b*, starting with figure 10*a*, the groove 17 of the collet 16*d*1 of FIG. 5*b* is illustrated. In FIG. 10*a*, the groove 17 of collet 16*d*1 includes a first ledge 17*a* and a second ledge 17*b*. However, in figure 10*b*, the groove 17 only includes the first ledge 17*a*, not the second ledge 17*b*. In figure 10*a*, the second ledge 17*b* is used to close the ball valve 18*a* of FIG. 9*d* since the second ledge 17*b* of groove 17 contacts the first end 24*a* of the collet fingers 24 in FIG. 9*c* when the shifting tool 16 runs through the center of the FIV of FIG. 9*c*, the second ledge 17*b* pushing the first end 24*a* upwardly and closing the ball valve 18*a*. The second ledge 17*b* also contacts the first end 34*a* of the isolation latch assembly 34 in FIG. 9*a* thereby moving the port 38 into alignment with the entry port 36 in FIG. 9*a* (see discussion below). On the other hand, the first ledge 17*a* of FIG. 10*a* will contact the second end 34*b* in FIG. 9*a* thereby moving the port 38 out of alignment with the entry port 36, and the first ledge 17*a* will also contact the second end 24*b* in FIG. 9*c* thereby reopening the ball valve 18*a*, as discussed below. In FIG. 10*b*, since there is no second ledge 17*b*, there is no second ledge 17*b* to contact the first end 24*a* in FIG. 9*c* for closing the ball valve 18*a* in FIG. 9*d*, and there is no second ledge 17*b* for contacting the first end 34*a* in FIG. 9*a* for moving the port 38 into alignment with the entry port 36 in FIG. 9*a*.

A functional description of the operation of the formation isolation valve (FIV) 18 of the present invention, when used in conjunction with the shifting tool 16 of FIGS. 5*a*–5*b*, is set forth below with reference to FIGS. 1, 5*a*, 5*b*, and 9*a* through 9*d* of the drawings.

In FIG. 1, the perforating gun 10 and the shifting tool 16 suspend from the tubing string 14 in the wellbore 12. The perforating gun 10 has already perforated the formation penetrated by the wellbore 12, as shown in FIG. 1. The valve 18*a* is open, and the operator at the wellbore surface is withdrawing the perforating gun 10 to the surface of the wellbore. Since the shifting tool 16 is connected to a bottom of the perforating gun 10, the shifting tool 16 is also being withdrawn to the surface of the wellbore. Eventually, the shifting tool 16, connected to the bottom of the perforating gun 10, enters the formation isolation valve (FIV) 18 in FIG. 1 and runs through the center of the FIV 18. As the collet 16*d*1 of the shifting tool 16 (of FIG. 5*a*) enters the FIV 18 and runs through the center thereof, the collet 16*d*1 of shifting tool 16 will pass through: the ball valve 18*a* of FIG. 9*d*, the ball operator 18*b* of FIG. 9*c*, and the collet fingers 24 of FIG. 9*c*. When the collet 16*d*1 of shifting tool 16 passes through the collet fingers 24 in FIG. 9*c*, the groove 17 in the collet 16*d*1 of the shifting tool 16 will surround the first end 24*a* of the collet fingers 24 in FIG. 9*c*. As the shifting tool 16 continues to run through the center of the FIV 18, because the groove 17 surrounds the first end 24*a* of the collet finger 24, the groove 17 of collet 16*d*1 will force the collet fingers 24 of FIG. 9*c* to move longitudinally in an upward direction in the FIV 18. When the collet finger 24 moves longitudinally in the upward direction in the FIV, the ball operator 18*b* of FIG. 9*c* also moves longitudinally in the upward direction in the FIV 18. Since the ball operator 18*b* is connected to the ball valve 18*a*, movement of the ball operator 18*b* in the upward direction will rotate the ball valve 18*a*. Since the ball valve 18*a* was initially disposed in an open position, rotation of the ball valve 18*a* will close the ball valve 18*a*. When the ball valve 18*a* closes in response to a rotation of the ball valve 18*a* and movement of the ball operator 18*b*, the first end 24*a* of the collet finger 24 in FIG. 9*c* will fall into the interior groove 26*a* in the outer housing 26. When the first end 24*a* of collet finger 24 falls into the interior groove 26*a* of the outer housing 26, the groove 17 of the collet 16*d*1 of the shifting tool 16 will no longer surround the first end 24*a* of the collet finger 24. The shifting tool 16 and associated perforating gun 10 is now free to continue its upward movement longitudinally through the interior full bore of the FIV 16. The ball valve 18*a*, at this point, is closed; however, the collet 16*d*1 of the shifting tool 16 is still disposed adjacent the interior groove 26*a* in FIG. 9*c*. The upward movement of the shifting tool 16 through the center full bore of the FIV 18 of FIGS. 9*a*, 9*b*, and 9*c* continues. As the upward movement of the shifting tool 16 continues, the groove 17 of the collet 16*d*1 of the shifting tool 16 will now surround the first end 34*a* of the first collet finger of the isolation latch assembly 34 in FIG. 9*a*. As a result, any further upward movement of the shifting tool 16 will also force the isolation latch assembly 34 to move upward (because the groove 17 of collet 16*d*1 of the shifting tool 16 will force the first end 34*a* of the first collet finger of the assembly 34 to move upward, and the upward movement of the first end 34*a* in FIG. 9*a* will cause the isolation latch assembly 34 to move upward). When the isolation latch assembly 34 moves upwardly, the port 38 in the isolation latch assembly 34 will move into alignment with the entry port 36 in the rupture disc sub 32. When the port 38 moves into alignment with the entry port 36, the fluid communication channel 18*d* in FIG. 9*a* is open to the fluid pressure existing inside the full bore of the FIV 18 and, since the valve 18*a* is currently in the closed position, the valve 18*a* can now be reopened when the full bore fluid pressure is greater than or equal to the threshold pressure value rating of the first rupture disc 30 in FIG. 9*b*. In the meantime, the perforating gun 10 and shifting tool 16 are withdrawn to the surface of the wellbore, and, as a result, the first end 34*a* of the first collet finger of the isolation latch assembly 34 falls into the interior groove 32*a* on the interior of the rupture disc sub 32 while the second end 34*b* moves radially inwardly since it moves out of its own detent 34*b*1.

Assume that the operator at the wellbore surface notices that the perforating gun 10 did not detonate and there may not be any perforations in the formation 20 penetrated by the wellbore 12. It is necessary to lower another perforating gun downhole to perforate the formation. Another shifting tool 16 is connected to the lower part of another perforating gun 10 and the gun suspends from a tubing string 14. The perforating gun 10 and the shifting tool 16 are lowered into the wellbore, the shifting tool 16 being connected to the lower part of the perforating gun 10. As the perforating gun 10 and the shifting tool 16 is lowered downhole, the groove 17 of the collet 16*d*1 of the shifting tool 16 surrounds the second end 34*b* of the second collet finger of the isolation latch assembly 34 in FIG. 9*a* (recall that the second end 34*b* is not disposed in its own detent 34*b*1). As the shifting tool 16 moves downwardly, the groove 17 in collet 16*d*1 forces the second end 34*b* to move downwardly. As a result, the port 38 moves out of alignment with the entry port 36. Eventually, the second end 34*b* falls back into its own detent 34*b*1 in FIG. 9*a* and, as a result, the shifting tool 16 may now continue its downward descent into the borehole.

During the downward descent of the shifting tool 16, the groove 17 of the collet 16*d*1 of the shifting tool 16 now begins to surround the second end 24*b* of the second collet finger 24 in FIG. 9*c* (recall that the second end 24*b* is not disposed in its own detent 24*b*1). The second collet finger 24 is connected to the ball operator 18*b*. Therefore, as the shifting tool 16 moves downwardly, the groove 17 forces the second end 24*b* of the collet finger 24 to move downwardly, and, since the collet finger 24 is connected to the ball operator 18*b*, when the collet finger 24 moves downwardly, the ball operator 18*b* moves downwardly thereby rotating the ball valve 18*a*. Since the ball valve 18*a* is currently closed, any rotation of the ball valve 18*a* will reopen the ball valve 18*a*. Eventually, the second end 24*b* of the collet finger 24 falls back into its own detent 24*b*1 and, as a result, the perforating gun 10 and the shifting tool 16 can be lowered downhole, through the open valve 18*a*, for the purpose of perforating the formation 20 penetrated by the wellbore 12.

Assume now that the perforating gun 10 did, in fact, perforate the formation 20. It is necessary to withdraw the perforating gun 10 and shifting tool 16 uphole, and reclose the ball valve 18*a*, so that a tool string of any desired length may be built in the space 22 above the closed ball valve 18*a* of FIG. 1. In order to reclose the ball valve 18*a*, the same procedure outlined above is utilized. That is, the perforating gun 10 and shifting tool 16 are withdrawn to the surface of the wellbore 12. The groove 17 in the collet 16*d*1 of the shifting tool 16 will catch and surround the first end 24*a* of the collet fingers 24 in FIG. 9*c* thereby pulling the first end 24*a*, the collet fingers 24, and the ball operator 18*b* upwardly to the surface of the wellbore 12. The upward movement of the ball operator 18*b* will reclose the ball valve 18*a*. The first end 24*a* of the collet finger 24 will fall into the interior groove 26*a* in FIG. 9*c*, and the groove 17 of the collet 16*d*1 will be released from the first end 24*a* and the collet 16*d*1 will continue its travel uphole. The ball valve 18*a* is now closed. The groove 17 in the collet 16*d*1 will catch and surround the first end 34*a* of the isolation latch assembly 34 in FIG. 9*a* thereby forcing the first end 34*a* upwardly, forcing the isolation latch assembly 34 upwardly, and forcing the port 38 in the isolation latch assembly 34 to move into alignment with the entry port 36 in the rupture disc sub 32 of FIG. 9*a*. The first end 34*a* falls into the interior groove 32*a* in the rupture disc sub 32, and the perforating gun 10 and shifting tool 16 are withdrawn to the surface of the wellbore 12.

Since the formation 20 was, in fact, perforated as shown in FIG. 1, space 22 in FIG. 1 is now empty, and a tool string of any desired length may now be built inside the space 22 which is disposed above the closed ball valve 18a in FIG. 1.

When the tool string of any desired length is built in space 22 of FIG. 1, and when it is necessary to lower such tool string downhole for the purpose of performing a wellbore operation, and recalling that the valve 18*a* is now closed, it is necessary to reopen the valve 18*a*. However, the shifting tool 16 is not connected to the tool string. As a result, it is necessary to reopen the ball valve 18*a* using a different method for opening the valve. Recall that, in FIG. 9*a*, the port 38 is aligned with the entry port 36 in the rupture disc sub 32. However, the fluid pressure in the FIV 18 (and the rupture disc sub 32) is currently below the threshold pressure value rating of the rupture disc 30 in FIG. 9*b*. In order to reopen the ball valve 18*a*, the pressure inside the FIV 18, and inside the fluid channel 18*d* of FIG. 9*b*, is increased above the threshold pressure value rating of the rupture disc 30 in FIG. 9*b*. As a result, the rupture disc 30 in FIG. 9*b* ruptures. Since the rupture disc 30 has ruptured, the fluid pressure inside the channel 18*d* is exerted against the piston 18*c*1 of the operator mandrel 18*c* in FIG. 9*b*. As a result, the piston 18*c*1 starts to move downwardly in FIG. 9*b*. The oil in the oil chamber 18*e* starts to meter slowly through the oil metering orifice 18*g* and into the atmospheric chamber 18*f*. However, when the cut 18*c*2 on that side of the operator mandrel 18*c* inside the oil chamber 18*e* is disposed adjacent the o-ring 18*c*3, the cut 18*c*2 will allow the oil in the oil chamber 18*e* to move very rapidly into the atmospheric chamber 18*f*. As a result, when the oil in oil chamber 18*e* meters slowly through the oil metering orifice 18*g* and into the atmospheric chamber 18*f*, a time delay occurs. That is, it takes a predetermined period of time (the time delay) for the oil in the oil chamber 18*e* to meter slowly through the oil metering orifice 18*g* into the atmospheric chamber 18*f*, and during that time, the piston 18*c*1 moves slowly and the operator mandrel 18*c* moves slowly. However, when the cut 18*c*2 in FIG. 9*b* reaches the o-ring seal 18*c*3, the oil in the oil chamber 18*e* moves very rapidly into the atmospheric chamber 18*f* and, as a result, the piston 18*c*1 moves very rapidly and it rapidly bottoms out against one end 18*g*1 of the oil metering orifice 18*g*. When the piston 18*c*1 bottoms out against the one end 18*g*1 of the oil metering orifice 18*g*, the operator mandrel 18*c* of FIG. 9*b* hits the ball operator 18*b* of FIG. 9*c* and the ball operator 18*b*, in turn, rotates the ball valve 18*a* thereby changing the ball valve 18*a* from the closed position to the open position. Now, a tool string of any desired length, which is currently disposed inside the space 22 of FIG. 1, can be lowered downhole for the purpose of performing further wellbore operations downhole during one trip into the wellbore. Since a limited tool string length is no longer a problem, it is no longer necessary to continually make up additional tool strings at the wellbore surface, following the performance of an initial wellbore operation by a first tool string, and to sequentially lower the additional tool strings downhole for the purpose of performing additional wellbore operations.

Finally, when the piston 18*c*1 bottoms out against the one side 18*g*1 of the oil metering orifice 18*g*, the pressure inside the channel 18*d*, and inside the first rupture disc 30 which is already ruptured, is increased further to a pressure which exceeds the threshold pressure value rating of the second rupture disc 28 that is disposed inside the piston 18*c*1. As a result, the second rupture disc 28 ruptures. Now, the pressure existing on one side of the piston 18*c*1 is equal to the pressure existing on the other side of the piston 18*c*1. As a result, the operator mandrel 18*c* can be moved upwardly at any time thereafter because the pressures existing on both sides of the piston 18*c*1 are approximately equal.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An apparatus for use in a wellbore, comprising:

a mandrel;

a valve operable by the mandrel;

a pressure-actuated assembly responsive to predetermined fluid pressure; and an isolation assembly actuatable between a first and a second position, the isolation assembly having a port through which fluid can flow to actuate the pressure-actuated assembly when the predetermined fluid pressure is present and the isolation assembly is in the first position.

2. The apparatus of claim 1, wherein fluid flow through the port to the pressure-actuated assembly is blocked when the isolation assembly is in the second position to prevent actuation of the pressure-actuated assembly.

3. The apparatus of claim 1, wherein the pressure-actuated assembly includes a rupture disc.

4. The apparatus of claim 1, wherein the pressure-actuated assembly includes a delay element that delays actuation of the mandrel after the predetermined fluid pressure is applied.

5. The apparatus of claim 1, wherein the pressure-actuated assembly includes a first chamber containing fluid and a second chamber, the first and second chambers being connected by an orifice, and wherein actuation of the pressure-actuated assembly causes fluid from the first chamber to flow through the orifice to the second chamber at a predetermined rate to provide a time delay.

6. The apparatus of claim 5, wherein the pressure-actuated assembly further includes a piston activated when the predetermined fluid pressure is present to push fluid from the first chamber into the second chamber.

7. The apparatus of claim 6, wherein the pressure0actuated assembly further includes a rupture disc that activates the piston when ruptured by the fluid pressure.

8. The apparatus of claim 1, further comprising a housing having a bore, the isolation assembly movable longitudinally in the bore between the first and second positions.

9. The apparatus of claim 8, wherein the housing includes a passage way, the port of the isolation assembly being aligned with the passage way when the isolation assembly is in the first position.

10. The apparatus of claim 1, wherein the isolation assembly includes a latching profile, and wherein the latching profile is adapted to couple to a shifting tool raised and lowered in the wellbore.

11. A valve assembly for use in a wellbore, comprising:

a mandrel;

a valve operable by the mandrel; and a pressure-actuated assembly that is responsive to predetermined fluid pressure greater than a threshold pressure to operate the mandrel, the pressure-actuated assembly including a delay mechanism activated by the predetermined fluid pressure to prevent operation of the mandrel until after a predetermined delay.

12. The valve assembly of the claim 11, wherein the delay mechanism includes a first chamber containing fluid, a second chamber, and an orifice between the first and second chambers through which the fluid can flow at a predetermined rate to provide a time delay.

13. The valve assembly of claim 12, wherein the delay mechanism further includes a piston actuated by the predetermined well pressure to move the fluid from the first chamber to the second chamber.

14. The valve assembly of claim 13, wherein the piston is moveable between a first position and a second position, the piston actuating the mandrel when the piston reaches the second position.

15. A method of operating a valve in a wellbore, comprising:

applying a predetermined fluid pressure greater than a threshold pressure to actuate the valve;

activating a pressure-actuated delay mechanism in response to application of the predetermined fluid pressure; and delaying actuation of the valve using the pressure-actuated delay mechanism.

16. A method of operating a valve in a wellbore, the valve operable by a mandrel, the method comprising:

moving, using a shifting tool, an isolation assembly between a first position and a second position, the isolation assembly allowing fluid communication to a pressure-actuated assembly when in the second position; and applying a predetermined fluid pressure greater than a threshold pressure to actuate the pressure-actuated assembly, the pressure-actuated assembly activating the mandrel in response to operate the valve.

17. The method of claim 16, wherein the pressure-actuated assembly includes a rupture disc that is ruptured in the presence of the applied predetermined fluid pressure.

* * * * *